US009227097B2

(12) United States Patent
Lee et al.

(10) Patent No.: US 9,227,097 B2
(45) Date of Patent: Jan. 5, 2016

(54) FIREPROOF RACK AND FIREPROOF METHOD THEREOF

(71) Applicant: INSTITUTE FOR INFORMATION INDUSTRY, Taipei (TW)

(72) Inventors: Po-Kuan Lee, Tainan (TW); Chung-Ting Kao, Taipei (TW)

(73) Assignee: INSTITUTE FOR INFORMATION INDUSTRY, Taipei (TW)

( * ) Notice: Subject to any disclaimer, the term of this patent is extended or adjusted under 35 U.S.C. 154(b) by 463 days.

(21) Appl. No.: 13/711,864

(22) Filed: Dec. 12, 2012

(65) Prior Publication Data

US 2014/0138103 A1 May 22, 2014

(30) Foreign Application Priority Data

Nov. 20, 2012 (TW) ..... 101143190 A

(51) Int. Cl.
*A62C 2/06* (2006.01)
*A62C 99/00* (2010.01)
*A62C 3/16* (2006.01)

(52) U.S. Cl.
CPC ..... *A62C 99/0009* (2013.01); *A62C 3/16* (2013.01)

(58) Field of Classification Search
CPC ..... A62C 2/06; A62C 3/16; A62C 99/0009
USPC ..... 169/45, 48, 46
See application file for complete search history.

(56) References Cited

U.S. PATENT DOCUMENTS

2003/0077396 A1* 4/2003 LeCompte et al. ..... 427/430.1
2004/0194657 A1* 10/2004 Lally ..... 106/18.12

* cited by examiner

*Primary Examiner* — Arthur O Hall
*Assistant Examiner* — Viet Le
(74) *Attorney, Agent, or Firm* — Birch, Stewart, Kolasch & Birch, LLP

(57) ABSTRACT

A fireproof rack for protecting an object is provided. The fireproof rack includes a major frame, a moveable frame, a fireproof chamber and a fireproof liquid. The moveable frame is slidably connected to the major frame, and the moveable frame slides between a first position and a second position relative to the major frame, and the object is disposed in the moveable frame, and the moveable frame and the object are in the first position under an operation mode. Under a fireproof mode, the moveable frame and the object slide to the second position, and are received in the fireproof chamber. The fireproof liquid is located in the fireproof chamber. When the moveable frame and the object are in the second position, the object is soaked in the fireproof liquid.

14 Claims, 7 Drawing Sheets

FIREPROOF RACK AND FIREPROOF METHOD THEREOF

CROSS REFERENCE TO RELATED APPLICATIONS

This Application claims priority of Taiwan Patent Application No. 101143190, filed on Nov. 20, 2012, the entirety of which is incorporated by reference herein.

BACKGROUND OF THE INVENTION

1. Field of the Invention

The present invention relates to a fireproof rack, and in particular, a fireproof rack utilizing fireproof liquid for fire resistance.

2. Description of the Related Art

Conventional fireproof racks, such as U.S. Pat. No. 6,536,169, have a specially designed rack body, which is filled with solid firestop material to protect computer servers thereon. However, the specially designed rack body is expensive, and has failed to gain popularity.

U.S. Pat. No. 6,158,833 discloses a fireproof rack providing a storage space surrounded by multiple thermal insulation walls. However, the thermal insulation wall is also expensive. Additionally, when the thermal insulation wall is broken, fireproofing ability decreases.

Therefore, a fireproof rack having a simple design, low cost, and sufficient fireproofing function is required by users of computer servers.

BRIEF SUMMARY OF THE INVENTION

In one embodiment of the invention, a fireproof rack for protecting an object is provided. The fireproof rack includes a major frame, a moveable frame, a fireproof chamber and a fireproof liquid. The moveable frame is slidably connected to the major frame, and the moveable frame slides between a first position and a second position relative to the major frame, and the object is disposed in the moveable frame, and the moveable frame and the object are in the first position under an operation mode. Under a fireproof mode, the moveable frame and the object slide to the second position, and are received in the fireproof chamber. The fireproof liquid is located in the fireproof chamber. When the moveable frame and the object are in the second position, the object is soaked in the fireproof liquid.

A fireproof method for protecting an object is provided, including the following steps. First, a fireproof rack is provided, wherein the fireproof rack comprises a major frame, a moveable frame, a fireproof chamber and a fireproof liquid, and the object is disposed in the moveable frame. Then, under a fireproof mode, the moveable frame slides from a first position to a second position relative to the major frame, and the moveable frame and the object are received in the fireproof chamber, wherein the object is soaked in the fireproof liquid when the moveable frame and the object are in the second position.

Utilizing the fireproof rack of the embodiment of the invention, a computer server is soaked in the fireproof liquid, which improves the fireproofing function. The fireproof chamber can be a standard cabinet, which has a simple structure, low cost and low structural strength.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
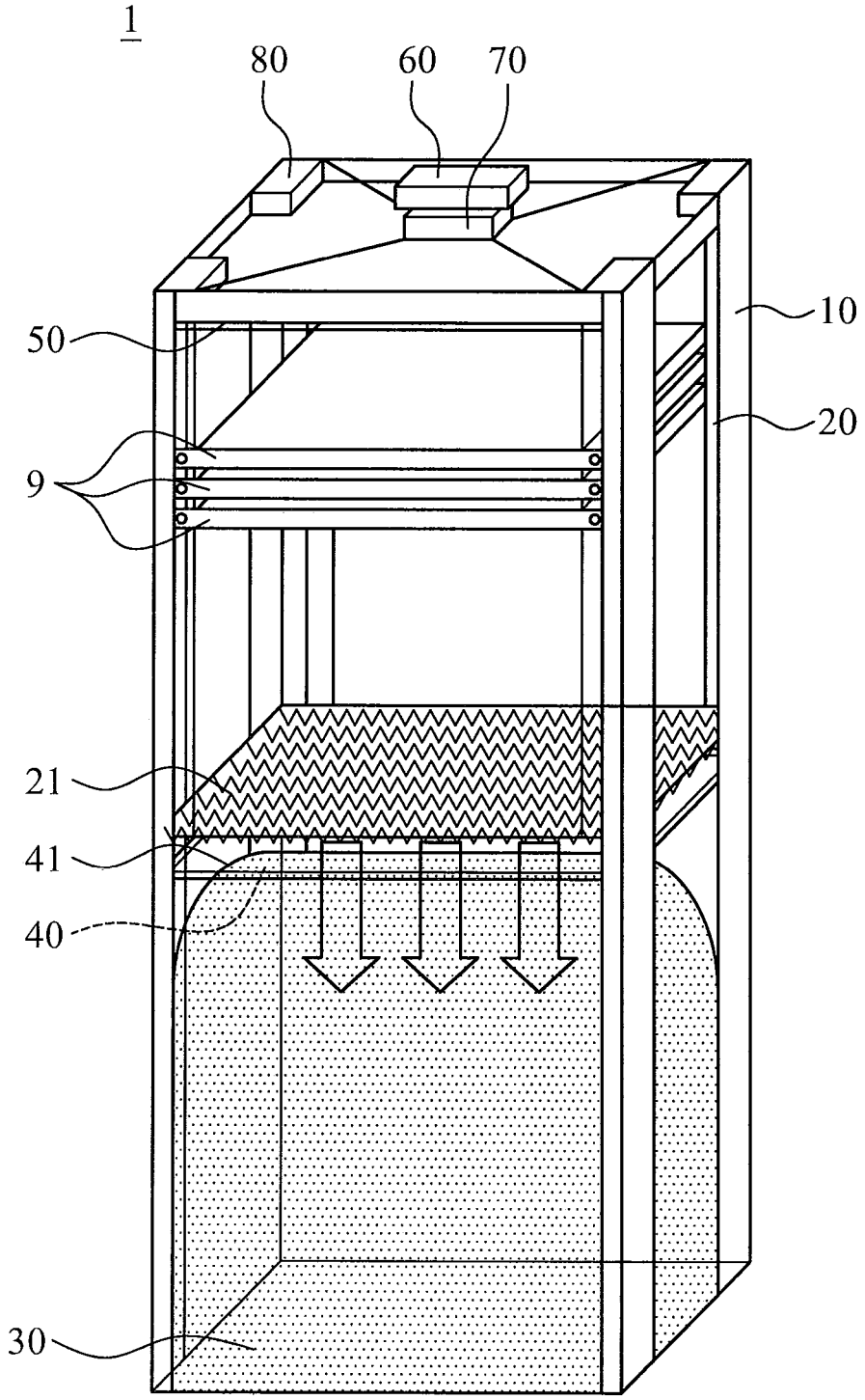
FIG. 1A shows the fireproof rack of the embodiment of the invention under the operation mode.
Figure 1B:
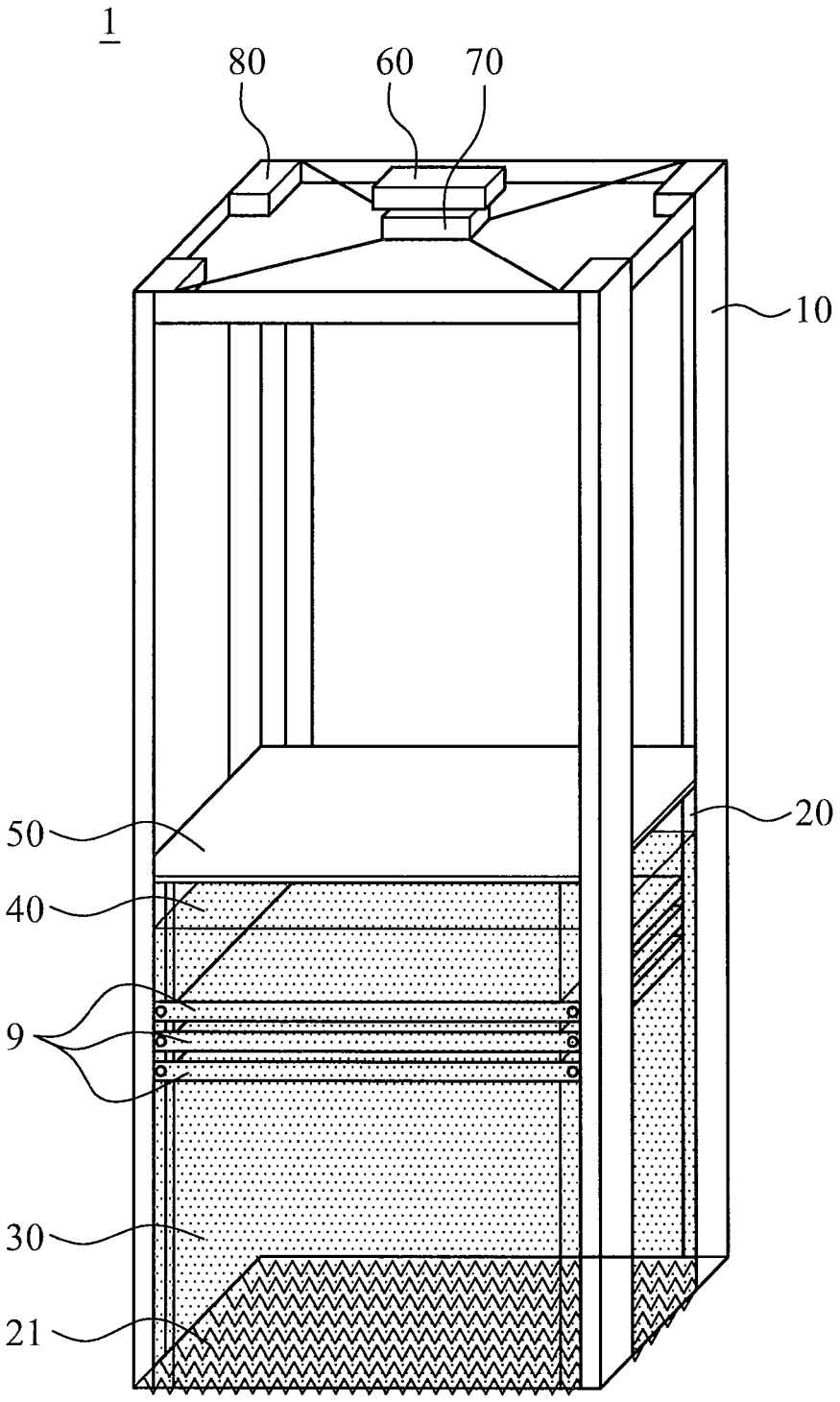
FIG. 1B shows the fireproof rack of the embodiment of the invention under the fireproof mode.

FIGS. 1A and 1B show a fireproof rack 1 of an embodiment of the invention for protecting a computer server 9. The fireproof rack 1 comprises a major frame 10, a moveable frame 20, a fireproof chamber 30 and a fireproof liquid 40. The moveable frame 20 is slidably connected to the major frame 10, wherein the moveable frame 20 slides between a first position (FIG. 1A) and a second position (FIG. 1B) relative to the major frame 10, wherein the computer server 9 (protection object) is disposed in the moveable frame 20.

With reference to FIG. 1A, under an operation mode, the moveable frame 20 and the computer server 9 are in the first position allowing users to operate the computer server 9.

With reference to FIG. 1B, under a fireproof mode, the moveable frame 20 and the computer server 9 slide from the first position to the second position, and are received in the fireproof chamber 30. The fireproof liquid 40 is located in the fireproof chamber 30. When the moveable frame 20 and the computer server 9 are in the second position, the computer server 9 is soaked in the fireproof liquid 40.

The fireproof liquid 40 can be liquid with high electric resistance, for example, deionized water or silicone oil. The unused fireproof liquid 40 can be packaged in the liquid package 41 (FIG. 1A). The moveable frame 20 comprises a spiny portion 21, and when the moveable frame 20 and the computer server 9 are moved from the first position to the second position, the spiny portion 21 penetrates the liquid package 41 to fill the fireproof chamber 30 with the fireproof liquid 40.

In one embodiment, a vacuum vapor deposition process can be utilized to coat, for example, poly-p-xylene on the computer server 9 to form a nano-scale waterproof film. The nano-scale waterproof film can prevent circuit shorting caused by impure water. In this embodiment, the fireproof liquid 40 is not limited to liquid with high electric resistance.

In one embodiment, the fireproof rack 1 further comprises a fireproof shield 50, wherein the fireproof shield 50 is disposed on the moveable frame 20, and the computer server 9 is located between the fireproof shield 50 and the spiny portion 21. When the moveable frame 20 and the computer server 9 are in the second position, the fireproof shield 50 covers the fireproof chamber 30.

For switching the fireproof rack 1 from the operation mode to the fireproof mode automatically, the fireproof rack 1 further comprises a temperature sensing unit 60, an active unit 70 and at least one positioning unit 80. The temperature sensing unit 60 is connected to the active unit 70, and the positioning unit 80 is connected to the active unit 70. Under the operation mode, the positioning unit 80 fixes the moveable frame 20 in the first position relative to the major frame 10. Under the fireproof mode, the active unit 70 activates the positioning unit 80 to release the moveable frame 20 according a sensing result of the temperature sensing unit 60, wherein the moveable frame 20 slides relative to the major frame 10.

Figure 2A:
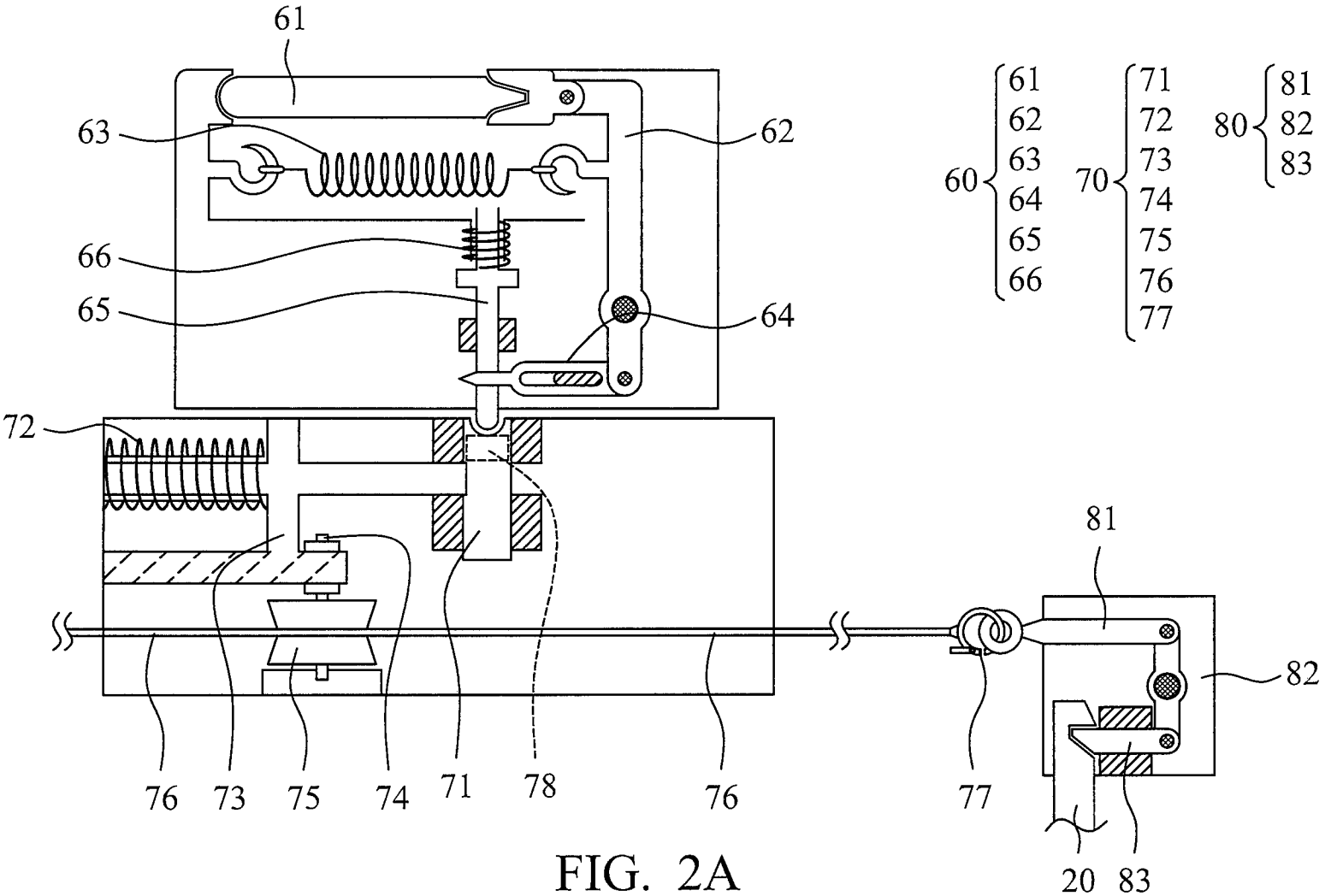
FIG. 2A shows the temperature sensing unit, the active unit and the positioning unit under the operation mode.
Figure 2B:
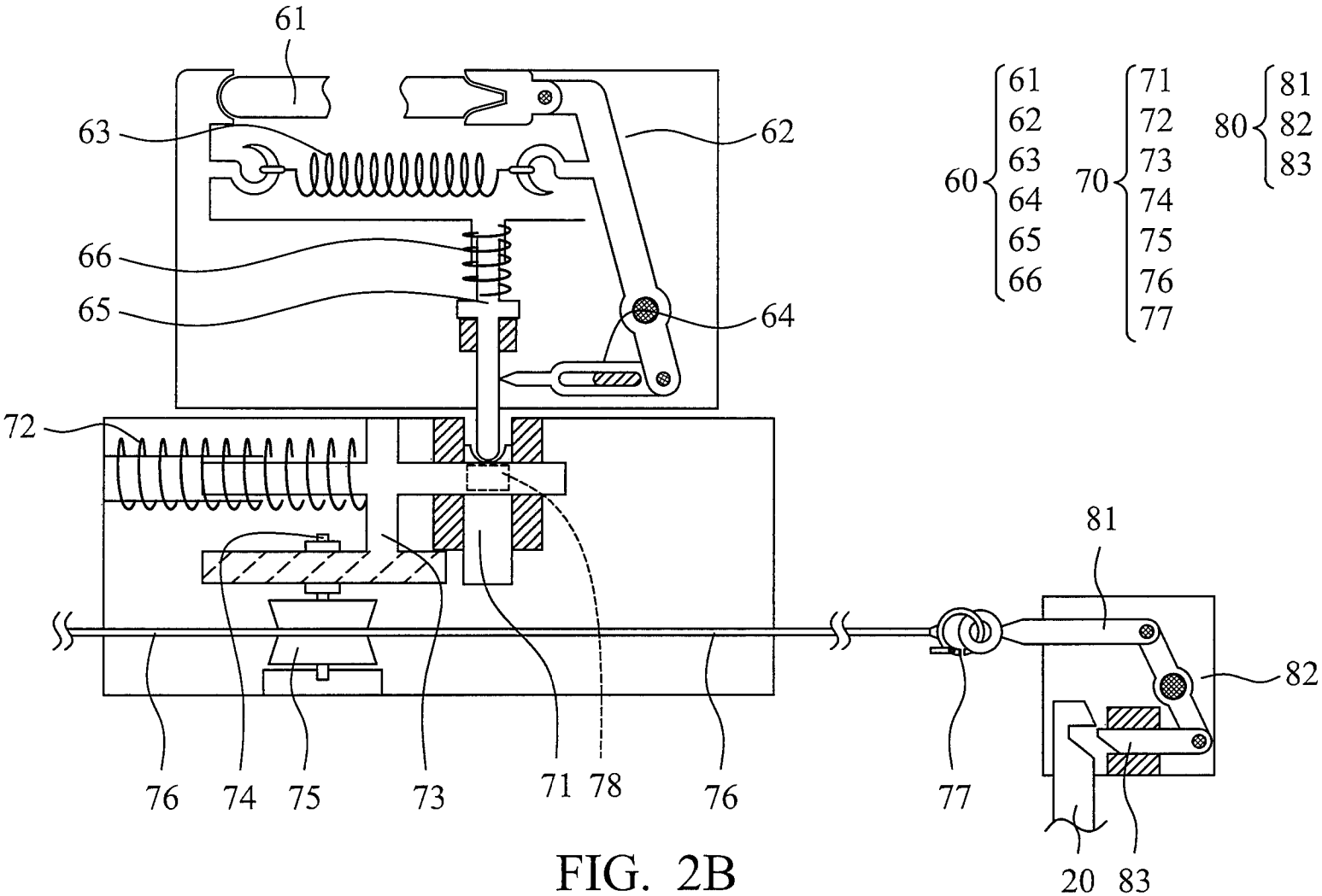
FIG. 2B shows the temperature sensing unit, the active unit and the positioning unit under the fireproof mode.

With reference to FIGS. 2A and 2B, the temperature sensing unit 60 comprises a glass alarm sensor 61, a transmission rod 62, a first elastic element 63, a restriction element 64, a pushing post 65 and a second elastic element 66. The glass alarm sensor 61 abuts an end of the transmission rod 62, the first elastic element 63 is connected to the transmission rod 62, the restriction element 64 is connected to another end of the transmission rod 62, the pushing post 65 abuts the restriction element 64, and the second elastic element 66 is telescoped on the pushing post 65.

When the glass alarm sensor 61 is broken, the fireproof rack 1 is under the fireproof mode, wherein the first elastic element 63 provides a pull force to rotate the transmission rod 62, the restriction element 64 is moved by the transmission rod 62 to be separated from the pushing post 65, and the pushing post 65 is moved by the second elastic element 66.

The active unit 70 comprises a block 71, a third elastic element 72, a transmission element 73, a gear 74, a reel 75, at least one line 76, and at least one hook 77. The pushing post 65 abuts the block 71, the third elastic element 72 is connected to the transmission element 73, the block 71 abuts the transmission element 73 to restrict a position of the transmission element 73, the gear 74 meshes the transmission element 73, the gear 74 is connected to the reel 75, an end of the line 76 is connected to the reel 75, and the hook 77 is connected to another end of the line 76.

A hole 78 is formed on the block 71. Under the fireproof mode, the pushing post 65 pushes the block 71, and the block 71 is moved such that the transmission element 73 is pushed by the third elastic element 72 to be partially inserted into the hole 78. Simultaneously, the transmission element 73 rotates the gear 74 and the reel 75, and the reel 75 winds up the line 76.

The positioning unit 80 comprises a first linkage 81, a second linkage 82 and a third linkage 83, and the first linkage 81 is connected to the second linkage 82, the second linkage 82 is connected to the third linkage 83, the hook 77 is connected to an end of the first linkage 81, and the third linkage 83 abuts the moveable frame 20.

Under the fireproof mode, the line 76 is winded to pull the hook 77 and the first linkage 81, the second linkage 82 is rotated by the first linkage 81, and the third linkage 83 is separated from the moveable frame 20 by the second linkage 82 to release the moveable frame 20.

Utilizing the fireproof rack of the embodiment of the invention, a computer server is soaked in the fireproof liquid, and the fireproofing function is improved. The fireproof chamber can be a standard cabinet, which has a simple structure, low cost and low structural strength.

Figure 3:
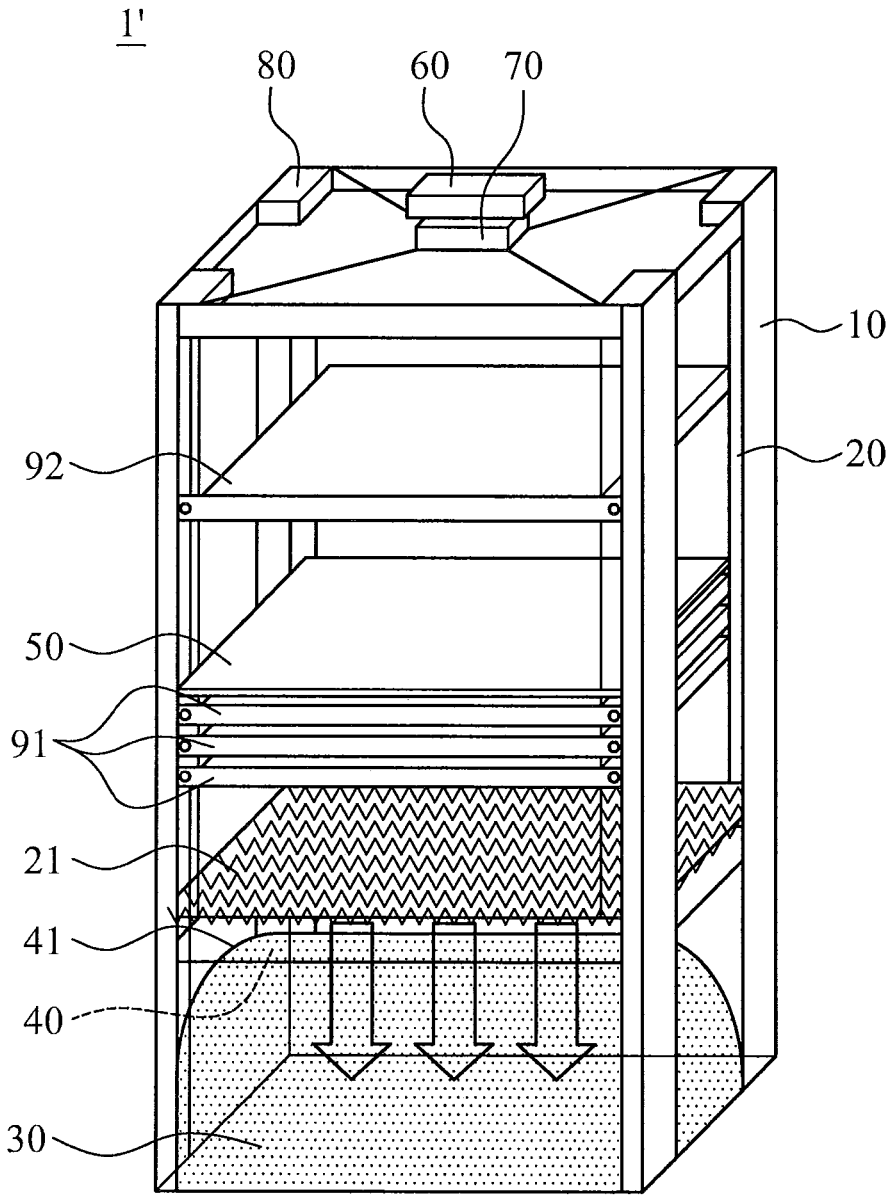
FIG. 3 shows the fireproof rack of another embodiment of the invention.

FIG. 3 shows a fireproof rack 1' of another embodiment of the invention, wherein a storage unit 91 of the computer server 9 is below the fireproof shield 50. Under the fireproof mode, the storage unit 91 enters the fireproof chamber 30 to be protected, and an operation unit 92 of the computer server 9 is exposed on the outside of the fireproof chamber 30. Therefore, the dimension of the fireproof chamber 30 can be reduced, and the environmental space can be used more effectively.

Figure 4A:
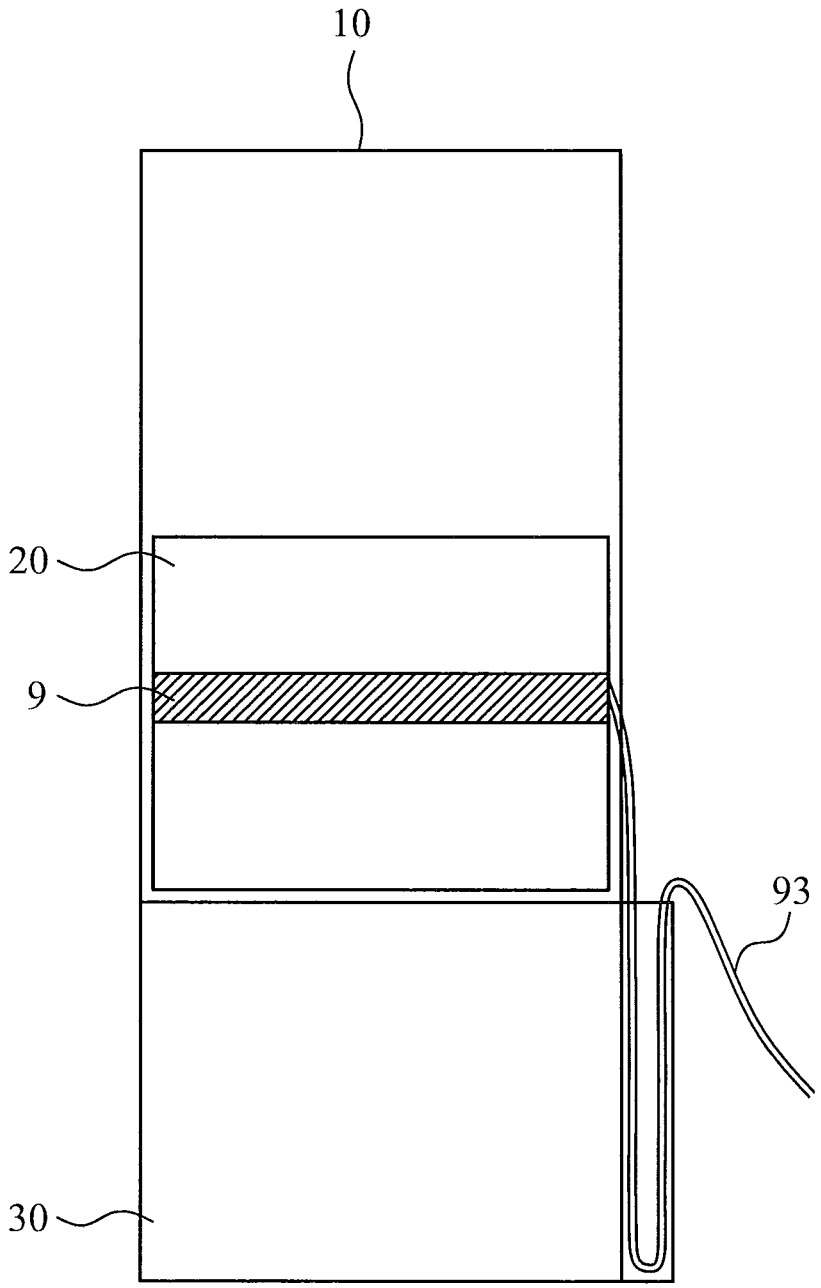
FIGS. 4A and 4B show the fireproof rack of the embodiment of the invention, wherein the wire of the computer server is prevented from interfering with the fireproof chamber.
Figure 4B:
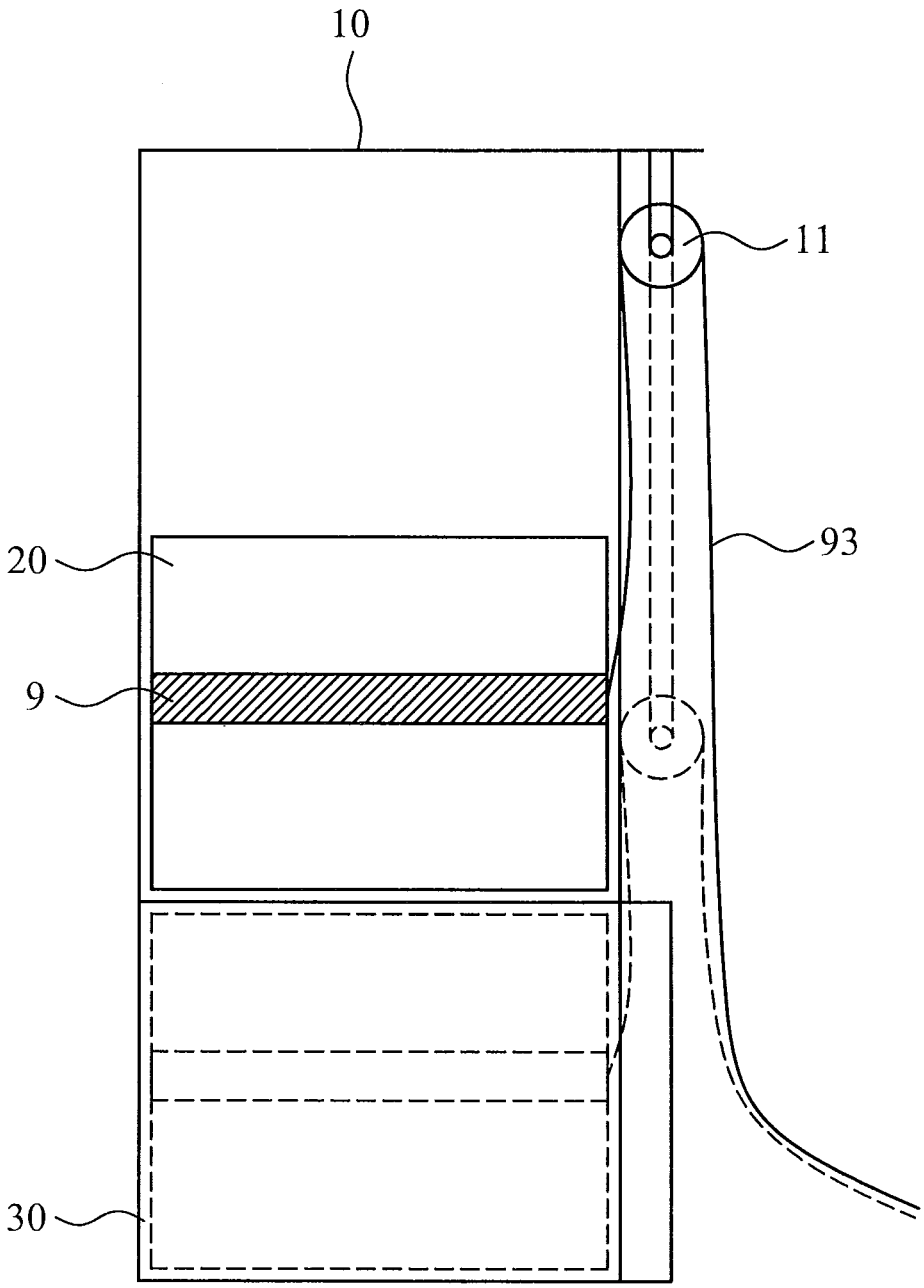

With reference to FIG. 4A, in one embodiment of the invention, the length of the fireproof chamber 30 is longer than the length of the computer server 9. When the computer server 9 enters the fireproof chamber 30, a wire 93 of the computer server 9 is prevented from interfering with the fireproof chamber 30, and the computer server 9 can smoothly enter the fireproof chamber 30. With reference to FIG. 4B, in one embodiment, a wheel 11 can be disposed on the major frame 10. The position of the wheel 11 can be changed with the position of the moveable frame 20, and the wire 93 is guided by the wheel 11 to prevent the wire 93 from interfering with the fireproof chamber 30.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fireproof rack, for protecting an object, comprising:

a major frame;

a moveable frame, slidably connected to the major frame, wherein the moveable frame slides between a first position and a second position relative to the major frame, and the object is disposed in the moveable frame, and the moveable frame and the object are in the first position under an operation mode;

a fireproof chamber, wherein under a fireproof mode, the moveable frame and the object slide to the second position, and are received in the fireproof chamber;

a fireproof liquid, located in the fireproof chamber, wherein when the moveable frame and the object are in the second position, the object is soaked in the fireproof liquid; and a liquid package, wherein the fireproof liquid is contained in the liquid package, and the moveable frame comprises a spiny portion, and when the moveable frame and the object are moved from the first position to the second position, the spiny portion penetrates the liquid package to fill the fireproof chamber with the fireproof liquid.

2. The fireproof rack as claimed in claim 1, wherein the fireproof liquid comprises deionized water or silicone oil.

3. The fireproof rack as claimed in claim 1, further comprising a fireproof shield, wherein the fireproof shield is disposed on the moveable frame, and the object is located between the fireproof shield and the spiny portion, and when the moveable frame and the object are in the second position, the fireproof shield covers the fireproof chamber.

4. The fireproof rack as claimed in claim 1, further comprising a temperature sensing unit, an active unit and at least one positioning unit, wherein the temperature sensing unit is connected to the active unit, and the positioning unit is connected to the active unit, and under the operation mode, the positioning unit fixes the moveable frame in the first position relative to the major frame, and under the fireproof mode, the active unit activates the positioning unit to release the moveable frame according a sensing result of the temperature sensing unit, wherein the moveable frame slides relative to the major frame.

5. The fireproof rack as claimed in claim 4, wherein the temperature sensing unit comprises a glass alarm sensor, a transmission rod, a first elastic element, a restriction element, a pushing post and a second elastic element, and the glass alarm sensor abuts an end of the transmission rod, the first elastic element is connected to the transmission rod, and the restriction element is connected to another end of the transmission rod, the pushing post abuts the restriction element, and the second elastic element is telescoped on the pushing post.

6. The fireproof rack as claimed in claim 5, wherein when the glass alarm sensor is broken, the fireproof rack is under the fireproof mode, and the first elastic element provides a pull force to rotate the transmission rod, and the restriction element is moved by the transmission rod to be separated from the pushing post, wherein the pushing post is moved by the second elastic element.

7. The fireproof rack as claimed in claim 5, wherein the active unit comprises a block, a third elastic element, a transmission element, a gear, a reel, at least one line, and at least one hook, and the pushing post abuts the block, the third elastic element is connected to the transmission element, the block abuts the transmission element to restrict a position of the transmission element, the gear meshes the transmission element, the gear is connected to the reel, an end of the line is connected to the reel, and the hook is connected to another end of the line.

8. The fireproof rack as claimed in claim 7, wherein under the fireproof mode, the pushing post pushes the block, the block is moved to release the transmission element, the transmission element is pushed by the third elastic element to rotate the gear and the reel, and the reel winds up the line.

9. The fireproof rack as claimed in claim 8, wherein a hole is formed on the block, wherein under the fireproof mode, the transmission element is pushed by the third elastic element to be partially inserted into the hole.

10. The fireproof rack as claimed in claim 7, wherein the positioning unit comprises a first linkage, a second linkage and a third linkage, and the first linkage is connected to the second linkage, the second linkage is connected to the third linkage, the hook is connected to an end of the first linkage, and the third linkage abuts the moveable frame.

11. The fireproof rack as claimed in claim 10, wherein under the fireproof mode, the line is winded to pull the hook and the first linkage, the second linkage is rotated by the first linkage, and the third linkage is separated from the moveable frame by the second linkage to release the moveable frame.

12. A fireproof method for protecting an object, comprising:

providing a fireproof rack, wherein the fireproof rack comprises a major frame, a moveable frame, a fireproof chamber and a fireproof liquid, and the object is disposed in the moveable frame;

under a fireproof mode, the moveable frame sliding from a first position to a second position relative to the major frame, and receiving the moveable frame and the object in the fireproof chamber; wherein the object is soaked in the fireproof liquid when the moveable frame and the object are in the second position, wherein the fireproof rack further comprises a liquid package, wherein the fireproof liquid is contained in the liquid package, and the moveable frame comprises a spiny portion, and when the moveable frame and the object are moved from the first position to the second position, the spiny portion penetrates the liquid package to fill the fireproof chamber with the fireproof liquid.

13. The fireproof method as claimed in claim 12, wherein the fireproof rack further comprises a fireproof shield, wherein the fireproof shield is disposed on the moveable frame, and the object is located between the fireproof shield and the spiny portion, and when the moveable frame and the object are in the second position, the fireproof shield covers the fireproof chamber.

14. The fireproof method as claimed in claim 12, wherein the fireproof rack further comprises a temperature sensing unit, an active unit and at least one positioning unit, wherein the temperature sensing unit is connected to the active unit, and the positioning unit is connected to the active unit, and under the operation mode, the positioning unit fixes the moveable frame in the first position relative to the major frame, and under the fireproof mode, the active unit activates the positioning unit to release the moveable frame according a sensing result of the temperature sensing unit, wherein the moveable frame slides relative to the major frame.

* * * * *